US008351617B2

(12) United States Patent
Zhang et al.

(10) Patent No.: US 8,351,617 B2
(45) Date of Patent: Jan. 8, 2013

(54) METHOD FOR PHASE MISMATCH CALIBRATION FOR AN ARRAY MICROPHONE AND PHASE CALIBRATION MODULE FOR THE SAME

(75) Inventors: Ming Zhang, Cupertino, CA (US); Xiaoyan Lu, Nanjing (CN)

(73) Assignee: Fortemedia, Inc., Sunnyvale, CA (US)

( * ) Notice: Subject to any disclaimer, the term of this patent is extended or adjusted under 35 U.S.C. 154(b) by 1032 days.

(21) Appl. No.: 12/352,666

(22) Filed: Jan. 13, 2009

(65) Prior Publication Data

US 2010/0179806 A1 Jul. 15, 2010

(51) Int. Cl.
*H04R 3/00* (2006.01)

(52) U.S. Cl. ..... 381/92; 381/122; 381/313; 381/317; 381/320

(58) Field of Classification Search ..... 381/92, 381/71.1, 71.4, 71.3, 94.2, 94.3, 94.7, 95, 381/97, 98, 122, 313, 312, 316, 317, 318, 381/320, 321, 94.9, 60, 23.1
See application file for complete search history.

(56) References Cited

U.S. PATENT DOCUMENTS

| | | | | |
|---|---|---|---|---|
| 6,044,162 | A * | 3/2000 | Mead et al. | 381/312 |
| 6,272,229 | B1 * | 8/2001 | Baekgaard | 381/313 |
| 7,171,357 | B2 * | 1/2007 | Boland | 704/231 |
| 8,064,617 | B2 * | 11/2011 | Buck et al. | 381/92 |
| 2002/0041696 | A1 * | 4/2002 | Jensen | 381/317 |

* cited by examiner

*Primary Examiner* — Vivian Chin
*Assistant Examiner* — Leshui Zhang
(74) *Attorney, Agent, or Firm* — McClure, Qualey & Rodack, LLP

(57) ABSTRACT

The invention provides a phase calibration module, calibrating phase mismatch between microphone signals output by a plurality of microphones of an array microphone. In one embodiment, the phase calibration module comprises a subband filter, a delay calculation module, and a delay compensation filter. The subband filter extracts a high frequency component and a low frequency component from each of the microphone signals to obtain a plurality of high-frequency component signals and a plurality of low-frequency component signals. The delay calculation module calculates delays between the low-frequency component signals. The delay compensation filter then compensates the low-frequency component signals for phase mismatches therebetween according to the calculated delays to obtain a plurality of calibrated low-frequency component signals.

18 Claims, 3 Drawing Sheets

METHOD FOR PHASE MISMATCH CALIBRATION FOR AN ARRAY MICROPHONE AND PHASE CALIBRATION MODULE FOR THE SAME

BACKGROUND OF THE INVENTION

1. Field of the Invention

The invention relates to array microphones, and more particularly to phase mismatch calibration of output signals of array microphones.

2. Description of the Related Art

An array microphone is an apparatus comprising a plurality of microphones. When a sound propagates to a vicinity of the array microphone, each of the microphones of the array microphone respectively converts the sound to a microphone signal, thus obtaining a plurality of microphone signals. Due to slight spatial differences in sound receiving locations of the microphones, the microphone signals have a slight phase difference therebetween. A beamforming module can therefore determine a spatial direction of the sound according to the phase differences between the microphone signals and attenuates noise and interference coming from other directions. Thus, a target signal comprising a more desired sound component and less noise and interference is obtained.

Because the beamforming module determines the spatial direction of the sound according to the phase differences between the microphone signals, accuracy of the phase difference between the microphone signals determines precision of beamforming. The phase differences between the microphone signals generated by the array microphone, however, comprises delays resulting from circuit differences of the microphones rather than spatial differences in sound receiving locations of the microphones. The delays caused by circuit differences among different the microphones degrades precision of beamforming. Thus, a phase calibration module is required to compensate output signals of an array microphone for delays caused by circuit differences of microphones of the array microphone.

A conventional phase calibration module directly determines delays caused by circuit differences of microphones according to output signals of the microphones. The circuit differences of microphones of an array microphone, however, causes a much longer delay in low-frequency components of the microphone output signals than in high-frequency components of the microphone output signals. The low frequency components of the microphone output signals therefore have a greater signal distortion and phase mismatch than the high frequency components of the microphone output signals. Because the conventional phase calibration module does not differentiate between the low frequency components from the high frequency components in delay calculation and compensation, delays due to circuit differences cannot be compensated with a high precision, degrading performance of subsequent beamforming. Thus, a method for phase mismatch calibration for an array microphone is required.

BRIEF SUMMARY OF THE INVENTION

The invention provides a phase calibration module, calibrating phase mismatch between microphone signals output by a plurality of microphones of an array microphone. In one embodiment, the phase calibration module comprises a subband filter, a delay calculation module, and a delay compensation filter. The subband filter extracts a high frequency component and a low frequency component from each of the microphone signals to obtain a plurality of high-frequency component signals and a plurality of low-frequency component signals. The delay calculation module calculates delays between the low-frequency component signals. The delay compensation filter then compensates the low-frequency component signals for phase mismatches therebetween according to the calculated delays to obtain a plurality of calibrated low-frequency component signals.

The invention provides a method for phase mismatch calibration for an array microphone. In one embodiment, a plurality of microphones of the array microphone convert a sound into a plurality of microphone signals. First, a high frequency component and a low frequency component are extracted from each of the microphone signals to obtain a plurality of high-frequency component signals and a plurality of low-frequency component signals. Delays between the low-frequency component signals are then calculated. Phase mismatches between the microphone signals are then calibrated according to the calculated delays to obtain a plurality of calibrated signals.

The invention provides a voice processing apparatus. In one embodiment, the voice processing apparatus comprises an array microphone, a phase calibration module, and a beamforming/signal separation module. The array microphone generates a plurality of microphone signals with a plurality of microphones thereof. The phase calibration module extracts a high frequency component and a low frequency component from each of the microphone signals to obtain a plurality of high-frequency component signals and a plurality of low-frequency component signals, calculates delays between the low-frequency component signals, and calibrates phase mismatches between the microphone signals according to the calculated delays to obtain a plurality of calibrated signals. Finally, the beamforming/signal separation module derives a target signal without noise and interference from the calibrated signals according to beamforming or signal separation techniques.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
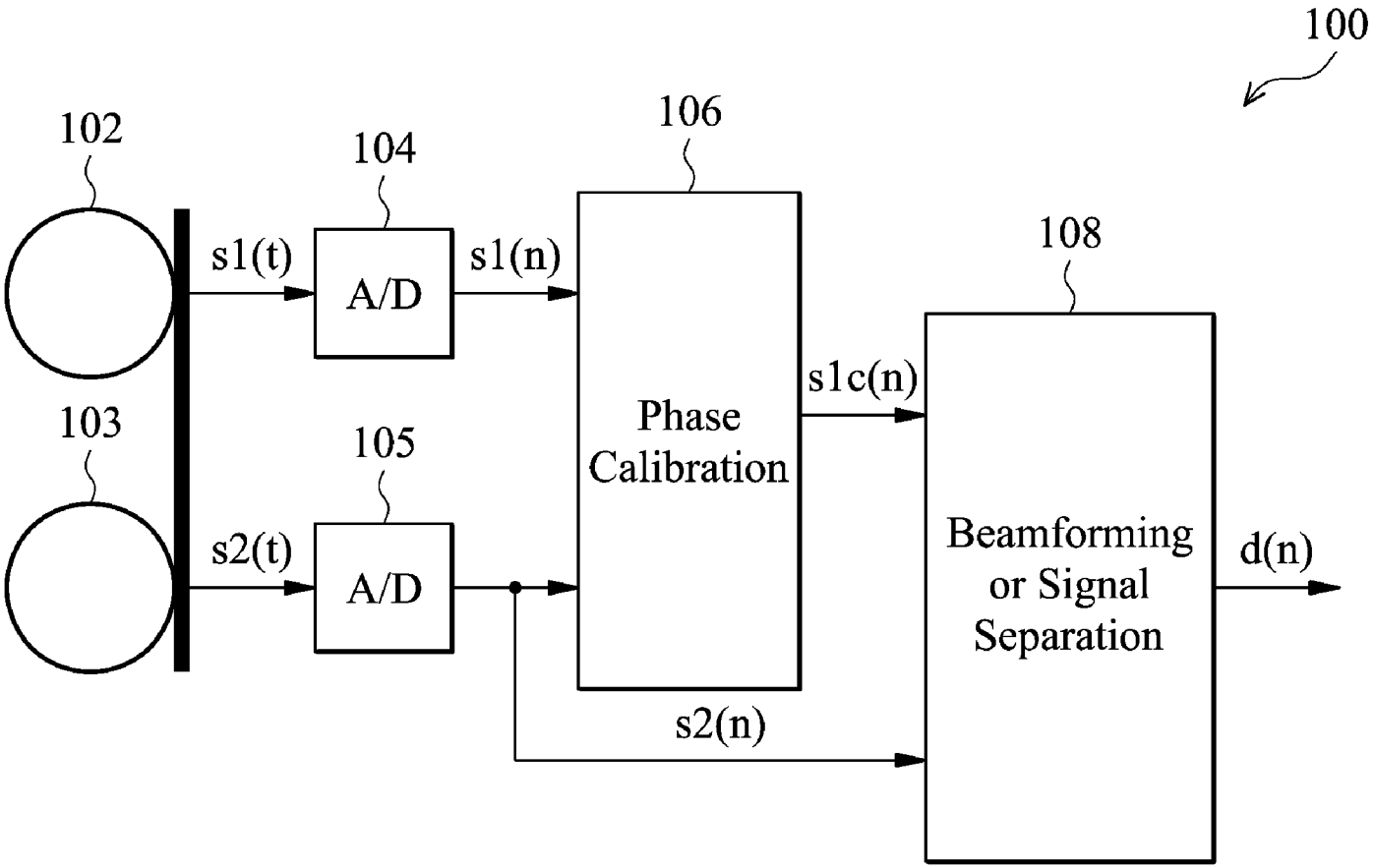
FIG. 1 is a block diagram of a voice processing apparatus according to the invention.

Referring to FIG. 1, a block diagram of a voice processing apparatus 100 according to the invention is shown. The voice processing apparatus 100 comprises an array microphone comprising microphones 102 and 103, analog-to-digital converters 104 and 105, a phase calibration module 106, and a beamforming/signal separation module 108. A sound source is assumed to be positioned at the same distances to the microphones 102 and 103. Thus, a sound generated by the sound source propagates to the microphones 102 and 103 at the same time. The microphones 102 and 103 respectively convert the sound to signals s1($t$) and s2($t$). The analog-to-digital converters 104 and 105 then respectively converts signals s1($t$) and s2($t$) from analog to digital to obtain signals s1($n$) and s2($n$).

Because the sound source is at the same distances to the microphones 102 and 103, the receiving location difference between the microphones 102 and 103 induces no phase mismatch or delay between the signals s1($n$) and s2($n$). When a delay between the signals s1($n$) and s2($n$) exists, the delay is completely due to circuit differences between the microphones 102 and 103. The phase calibration module 106 then calculates the delay between the signals s1($n$) and s2($n$). Before the delay is calculated, the phase calibration module 106 extracts high frequency components and low frequency components from each of the signals s1($n$) and s2($n$). The phase calibration module 106 then detects whether the high frequency components comprise voice components. If so, the phase calibration module 106 measures a delay between the low frequency components, and then compensates the signals s1($n$) and s2($n$) for phase mismatch therebetween according to the measured delay. Because there are only two microphone output signals s1($n$) and s2($n$), only one of the signals s1($n$) and s2($n$) is compensated. For example, the phase of the signal s1($n$) is adjusted according to the calculated delay to obtain a calibrated signal s1$c$($n$). In other embodiments, the array microphone comprises multiple microphones generating multiple microphone output signals, and the phase calibration module 106 calibrates the microphone output signals in a similar way.

The signals s1$c$($n$) and s2($n$) are then delivered to the beamforming/signal separation module 108. The beamforming/signal separation module 108 then derives a target signal d(n) with more voice components and attenuated noise and interference from the signals s1$c$($n$) and s2($n$) according to a beamforming technique or a signal separation technique. Because the phase calibration module 106 measures a delay between low frequency components of the signals s1($n$) and s2($n$) for calibration, the measured delay is more precise than that obtained according to the conventional method. Thus, the delay induced by circuit differences between the microphones 102 and 103 are well compensated, and phase mismatch between the calibrated signals s1$c$($n$) and s2($n$) completely reflects sound-receiving spatial differences of microphones 102 and 103, improving precision of the beamforming/signal separation module 108.

Figure 2:
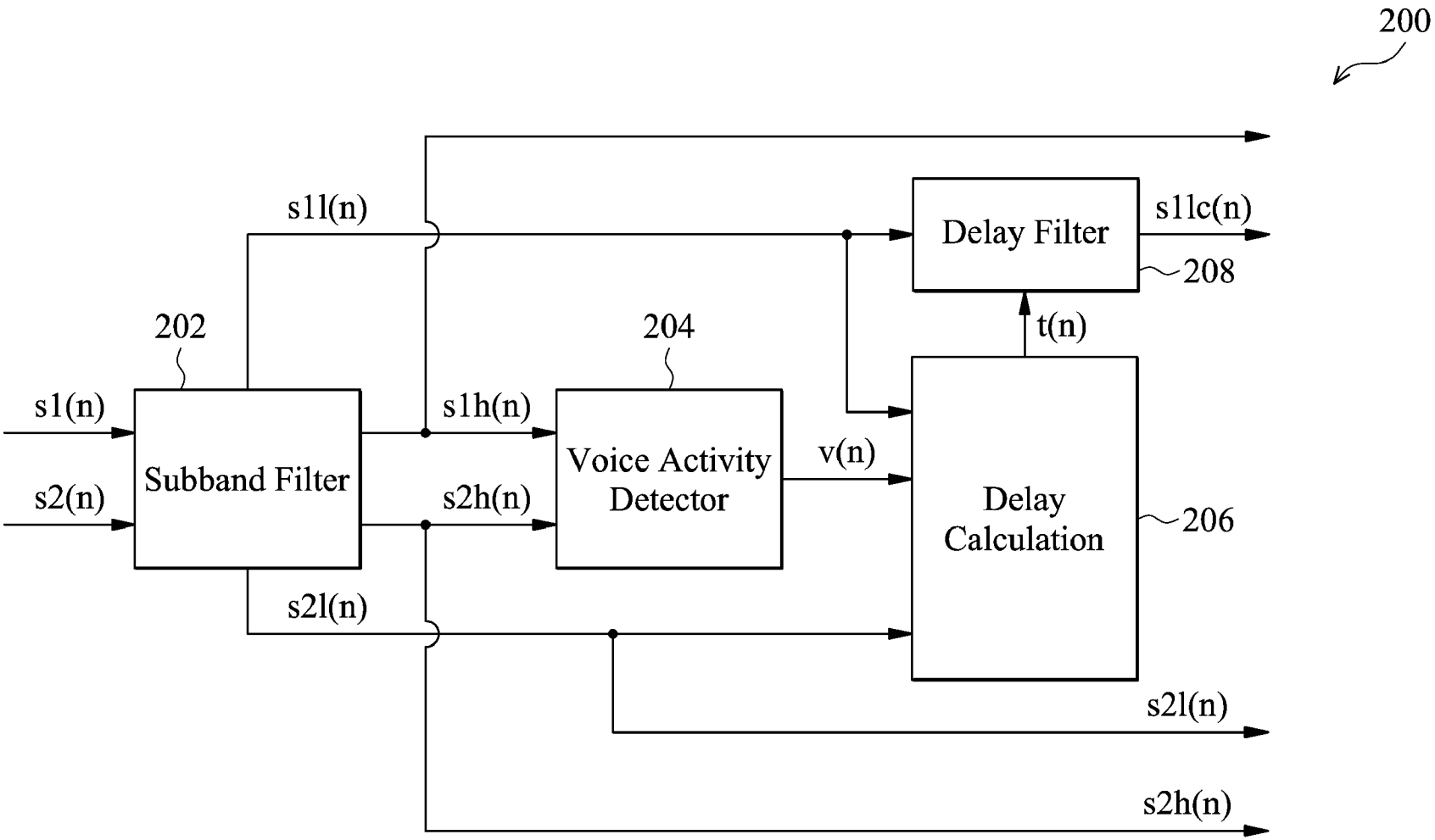
FIG. 2 is a block diagram of a phase calibration module according to the invention.

Referring to FIG. 2, a block diagram of a phase calibration module 200 according to the invention is shown. The phase calibration module 200 comprises a subband filter 202, a voice activity detector 204, a delay calculation module 206, and a delay filter 208. The signals s1($n$) and s2($n$) generated by the microphones 102 and 103 are first delivered to the subband filter 202. The subband filter 202 then separates the signal s1($n$) into a high-frequency component signal s1$h$($n$) and a low-frequency component signal s1$l$($n$), and separates the signal s2($n$) into a high-frequency component signal s2$h$ ($n$) and a low-frequency component signal s2$l$($n$). In one embodiment, the subband filter 202 comprises a high pass filter and a low pass filter. The high pass filter has a cut-off frequency which is equal to a boundary frequency and filters the signals s1($n$) and s2($n$) to obtain the high-frequency component signals s1$h$($n$) and s2$h$($n$). The low pass filter has a cut-off frequency which is equal to the boundary frequency and filters the signals s1($n$) and s2($n$) to obtain the low-frequency component signals s1($n$) and s2$l$($n$). In one embodiment, the boundary frequency delimiting the high frequency components s1$h$($n$) and s2$h$($n$) and the low frequency components s1$l$($n$) and s2$l$($n$) is a frequency ranging from 500 Hz to 1000 Hz.

The voice activity detector 204 then detects whether the high frequency component signals s1$h$($n$) and s2$h$($n$) comprises voice components. If so, a voice detection signal v(n) is generated to enable the delay calculation module 206. In one embodiment, the voice activity detector 204 detects whether powers of the high-frequency component signals s1$h$($n$) and s2$h$($n$) exceed a power threshold. If so, the high-frequency component signals s1$h$($n$) and s2$h$($n$) are determined to comprise voice components, and the voice detection signal v(n) is enabled to trigger the delay calculation module 206.

After the delay calculation module 206 is enabled, the delay calculation module 206 then calculates a delay t(n) between the low-frequency component signals s1($n$) and s2$l$ ($n$). In one embodiment, the delay calculation module 206 correlates the low-frequency component signals s1($n$) and s21($n$) to calculate the delay t(n) therebetween. Because there are only two microphone output signals s1($n$) and s2($n$), only one of the microphone output signals is required to be calibrated to have the same phase as the other. The delay t(n) is then sent to the delay filter 208, and the delay filter 208 calibrates the low frequency component signal s1$l$($n$) according to the delay t(n) to obtain a calibrated low-frequency component signal s1$lc$($n$). The calibrated low-frequency component signal s1$lc$($n$) and the corresponding high-frequency component signal s1$h$($n$) form a calibrated signal s1$c$($n$), as shown in FIG. 1. Thus, no delay between the calibrated signal s1$c$($n$) and the signal s2($n$) results from circuit differences between the microphones 102 and 103 and the analog-to-digital converters 104 and 105. The beamforming/signal separation module 108 can then derive the target signal d(n) from the calibrated signals s1$c$($n$) and s2($n$).

Figure 3:
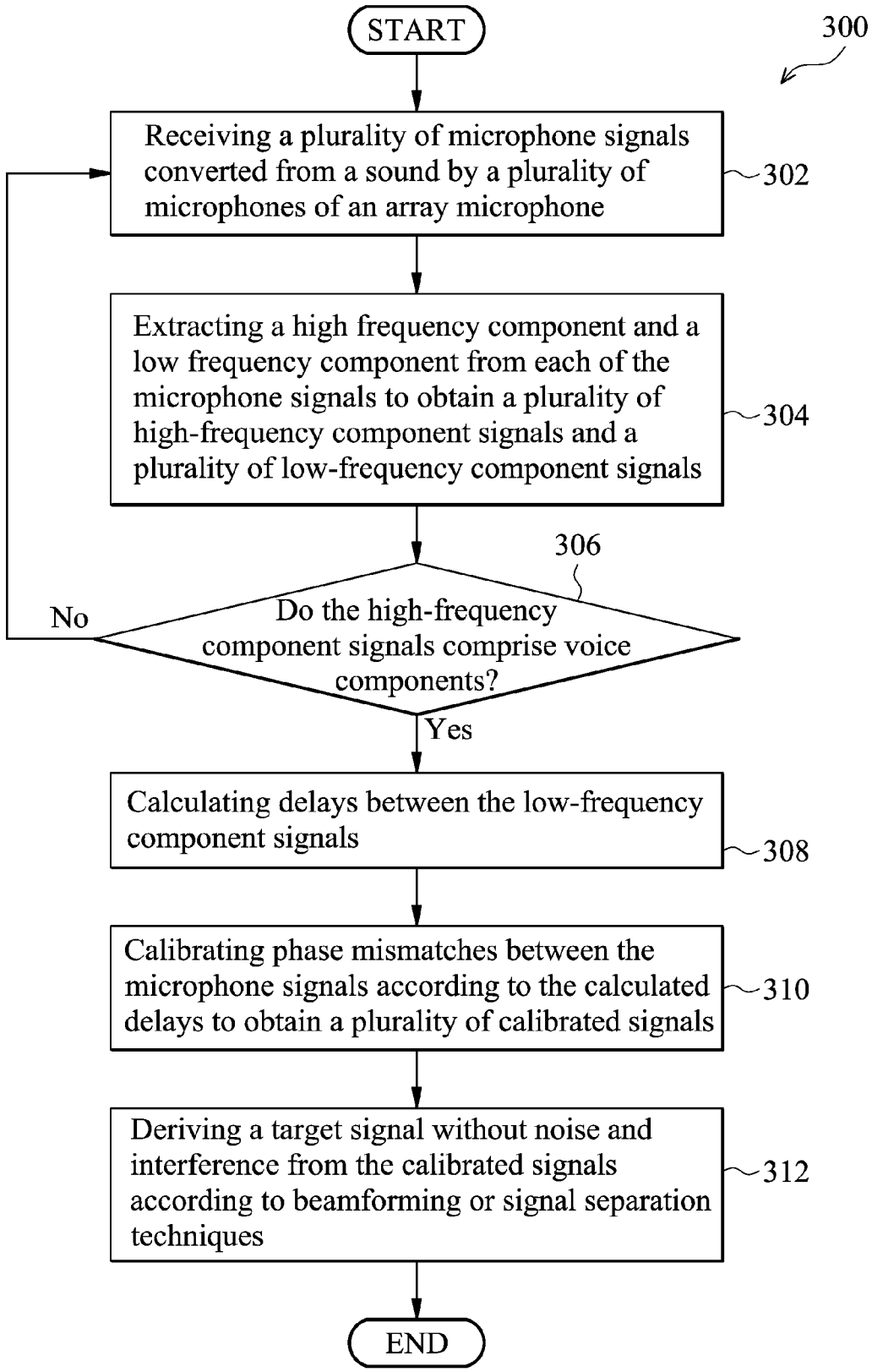
FIG. 3 is a flowchart of a method for phase mismatch calibration for an array microphone according to the invention.

Referring to FIG. 3, a flowchart of a method 300 for phase mismatch calibration for an array microphone according to the invention is shown. First, a plurality of microphone signals converted from a sound by a plurality of microphones of an array microphone are received (step 302). A high frequency component and a low frequency component are then extracted from each of the microphone signals to obtain a plurality of high-frequency component signals and a plurality of low-frequency component signals (step 304). Whether the high-frequency component signals comprise voice components is then detected (step 306). If so, delays between the low-frequency component signals are calculated (step 308). Phase mismatches between the microphone signals are then calibrated according to the calculated delays to obtain a plurality of calibrated signals (step 310). Finally, a target signal without noise and interference is derived from the calibrated signals according to beamforming or signal separation techniques (step 312).

The invention provides a phase calibration module. Low frequency components of signals generated by microphones of an array microphone are extracted as a source for calculating delays therebetween. Because circuit differences between microphones induce greater delays in low frequency components of microphone signals than in high frequency components of the microphone signals, the delays calculated according to the low frequency components are more precise, and phase mismatch calibration according to the calculated delays has better accuracy then that of a conventional calibration methods.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A phase calibration module, calibrating phase mismatch between microphone signals output by a plurality of microphones of an array microphone, comprising:

a subband filter, extracting a high frequency component and a low frequency component from each of the microphone signals to obtain a plurality of high-frequency component signals and a plurality of low-frequency component signals;

a delay calculation module, coupled to the subband filter, for calculating delays between the low-frequency component signals; and a delay compensation filter, coupled to the delay calculation module, for compensating the low-frequency component signals for phase mismatches therebetween according to the calculated delays to obtain a plurality of calibrated low-frequency component signals, wherein the phase calibration module further comprises a voice activity detector, detecting whether the high-frequency component signals comprise voice components to generate a voice detection signal enabling delay calculation of the delay calculation module.

2. The phase calibration module as claimed in claim 1, wherein the subband filter comprises a high pass filter and a low pass filter, wherein the high pass filter filters the microphone signals to obtain the high-frequency component signals according to a cutoff frequency which is equal to a boundary frequency, and the low pass filter filters the microphone signals to obtain the low-frequency component signals according to a cutoff frequency which is equal to the boundary frequency.

3. The phase calibration module as claimed in claim 2, wherein the boundary frequency is a frequency ranging from 500 Hz to 1000 Hz.

4. The phase calibration module as claimed in claim 1, wherein the voice activity detector detects whether powers of the high-frequency component signals exceed a power threshold to determine whether the voice detection signal is enabled.

5. The phase calibration module as claimed in claim 1, wherein the delay calculation module correlates the low-frequency component signals to calculate the delays therebetween.

6. The phase calibration module as claimed in claim 1, wherein combination of the high-frequency component signals and the calibrated low-frequency component signals form a plurality of calibrated signals respectively corresponding to the microphone signals, and a beamforming/signal separation module connected in series with the phase calibration module then derives a target signal without noise and interference from the calibrated signals according to beamforming or signal separation techniques.

7. A method for phase mismatch calibration for an array microphone, wherein a plurality of microphones of the array microphone convert a sound into a plurality of microphone signals, the method comprising:

extracting, by a subband filter, a high frequency component and a low frequency component from each of the microphone signals to obtain a plurality of high-frequency component signals and a plurality of low-frequency component signals;

calculating, by a delay calculation module, delays between the low-frequency component signals; and calibrating, by a delay compensation filter, phase mismatches between the microphone signals according to the calculated delays to obtain a plurality of calibrated signals, detecting whether the high-frequency component signals comprise voice components to generate a voice detection signal; and enabling calculation of the delays according to the voice detection signal.

8. The method as claimed in claim 7, wherein detection of whether the high-frequency component signals comprise voice components is determined according to whether powers of the high-frequency component signals exceed a power threshold.

9. The method as claimed in claim 7, wherein extraction of the high-frequency component signals and the low-frequency component signals comprises:

filtering the microphone signals with a high pass filter with a cutoff frequency which is equal to a boundary frequency to obtain the high-frequency component signals; and filtering the microphone signals with a low pass filter with a cutoff frequency which is equal to the boundary frequency to obtain the low-frequency component signals.

10. The method as claimed in claim 9, wherein the boundary frequency is a frequency ranging from 500 Hz to 1000 Hz.

11. The method as claimed in claim 7, wherein calculation of the delays comprises correlating the low-frequency component signals to calculate the delays therebetween.

12. The method as claimed in claim 7, wherein calibration of the phase mismatches comprises:

compensating the low-frequency component signals for phase mismatches therebetween according to the calculated delays to obtain a plurality of calibrated low-frequency component signals, wherein combination of the high-frequency component signals and the calibrated low-frequency component signals form the calibrated signals respectively corresponding to the microphone signals.

13. The method as claimed in claim 7, further comprises deriving a target signal without noise and interference from the calibrated signals according to beamforming or signal separation techniques.

14. A voice processing apparatus, comprising:

an array microphone, generating a plurality of microphone signals with a plurality of microphones thereof;

a phase calibration module, coupled to the array microphone, for extracting a high frequency component and a low frequency component from each of the microphone signals to obtain a plurality of high-frequency component signals and a plurality of low-frequency component signals, calculating delays between the low-frequency component signals, and calibrating phase mismatches between the microphone signals according to the calculated delays to obtain a plurality of calibrated signals; and a beamforming/signal separation module, coupled to the array microphone and the phase calibration module, for deriving a target signal without noise and interference from the calibrated signals according to beamforming or signal separation techniques, wherein the phase calibration module comprises:

a subband filter, extracting the high-frequency component signals and the low-frequency component signals from the microphone signals;

a delay calculation module, calculating the delays between the low-frequency component signals; and a delay compensation filter, compensating the low-frequency component signals for phase mismatches therebetween according to the calculated delays to obtain a plurality of calibrated low-frequency component signals;

wherein combination of the high-frequency component signals and the calibrated low-frequency component signals form the plurality of calibrated signals respectively corresponding to the microphone signals wherein the phase calibration module further comprises a voice activity detector, detecting whether the high-frequency component signals comprise voice components to generate a voice detection signal enabling delay calculation of the delay calculation module.

15. The voice processing apparatus as claimed in claim 14, wherein the subband filter comprises a high pass filter and a low pass filter, wherein the high pass filter filters the microphone signals to obtain the high-frequency component signals according to a cutoff frequency which is equal to a boundary frequency, and the low pass filter filters the microphone signals to obtain the low-frequency component signals according to a cutoff frequency which is equal to the boundary frequency.

16. The voice processing apparatus as claimed in claim 15, wherein the boundary frequency is a frequency ranging from 500 Hz to 1000 Hz.

17. The voice processing apparatus as claimed in claim 14, wherein the voice activity detector detects whether powers of the high-frequency component signals exceed a power threshold to determine whether the voice detection signal is enabled.

18. The voice processing apparatus as claimed in claim 14, wherein the delay calculation module correlates the low-frequency component signals to calculate the delays therebetween.

* * * * *